United States Patent [19]

Strain

[11] 4,117,796

[45] Oct. 3, 1978

[54] DOUBLE SECTIONED TANK

[76] Inventor: Patrick J. Strain, 27 Tanglewood Dr., Ottawa, Ontario, Canada, K2H 6P5

[21] Appl. No.: 820,703

[22] Filed: Aug. 1, 1977

[51] Int. Cl.[2] ..... B63B 25/12

[52] U.S. Cl. ..... 114/74 R; 220/85 B

[58] Field of Search ..... 220/85 B, 9 A, 9 LG; 114/74 R, 74 A, 74 T, 16 E, 121, 125, 256, 257

[56] References Cited

U.S. PATENT DOCUMENTS

| | | | |
|---|---|---|---|
| 2,461,537 | 2/1949 | Feild | 220/85 B |
| 3,477,401 | 11/1969 | Hayama | 220/85 B |
| 3,821,876 | 7/1974 | Glaspell | 220/85 B |
| 3,943,873 | 3/1976 | Hering | 114/74 R |

FOREIGN PATENT DOCUMENTS

| | | | |
|---|---|---|---|
| 369,844 | 1/1907 | France | 114/125 |
| 1,298,326 | 11/1962 | France | 220/85 B |

*Primary Examiner*—Trygve M. Blix
*Assistant Examiner*—D. W. Kern
*Attorney, Agent, or Firm*—W. Charles Kent

[57] ABSTRACT

A special type of tank that can be built into or placed in the cargo space of a ship to contain ballast water or another liquid without cross-contamination with the cargo residues, i.e. allowing for the carriage of segregated ballast in the cargo space. Allowance is also made for double-bottom space in the ship's loaded condition. A large part of the top, or lid, of the special tank is movable in a vertical direction from the highest part of the tank to the lowest part of the tank and special machinery and safety devices are fitted to expedite this movement. A rubber or flexible fabric sheet, which is watertight, connects the moveable and stationary part of the tank top and divides the tank into an upper and a lower section between which there is no communication. The flexible sheet is designed to take the internal contours of the inner tank when the cargo is loaded.

14 Claims, 7 Drawing Figures

DOUBLE SECTIONED TANK

BACKGROUND OF THE INVENTION

This invention relates generally to a tank which may be used for example on a ship such as an oil tanker, and more particularly concerns a tank which is expandable into the cargo space of such a ship yet which is physically separated therefrom. In recent years the carriage of oil by sea has grown to massive proportions, both in terms of the amount of oil that is carried and in the size of the ships that carry it. In general, the bulk of the oil is transported over long distances, from where it is produced to where it is consumed. Special ships known as oil tankers are used for carrying the oil. After discharge, the oil tankers usually return empty for the next load of oil.

Oil tankers are very safe and responsive ships from stability and manoeuvering points of view when in the loaded condition. However, they can be very unstable and practically unmanoeverable when in the fully unloaded condition. To overcome these defects oil tankers when in the unloaded condition are ballasted (i.e. loaded) with sea water to approximately one third of their maximum cargo capacity, for the return journey to load another oil cargo.

Until recently this ballast sea water was loaded directly into the nearly empty oil cargo tanks after these had been cleaned as far as practicable, and this is usually still the case with smaller oil tankers of less than 70,000 tons deadweight. As oil tanks are hard to clean, the system is prone to serious defects, in particular danger of pollution of the sea if the ballast water is discharged overboard prior to loading another oil cargo. For this reason many shipowners now fit separate ballast tanks used solely for the carriage of sea water ballast when the ship is returning to load. This segregated ballast system is practically 100 percent effective from a pollution prevention point of view, but it is very costly to the shipowner in that he has to provide the extra ballast tank capacity, which cannot be used for the carriage of cargo when the ship is loaded. As many governments now favour the segregated ballast system for ships in their territorial waters, the shipowner is faced with large constructional and operational costs for the segregated ballast tanks.

It is with a view to overcoming the above problem, while still retaining a 100 percent pollution free operation, that the system according to the present invention has been devised.

DESCRIPTION OF THE PRIOR ART

Previous attempts have been made to provide a container construction for a ship which will contain ballast water in cargo space without cross-examination. For example, U.S. Pat. No. 3,707,937 of Liles, describes and illustrates the container located within the compartment of a tanker, the container being constructed with a surrounding wall having contraction rings secured at intervals therearound so as to cause collapsing of the container in folds. This folding action is guided by rings secured to the wall of the container intermediate the folds. The container expands when ballast fluid is pumped into the container and collapsed to a compact relation to allow filling of the compartment with oil or other cargo.

U.S. Pat. No. 3,943,873 of Hering illustrates a ballasting system for ships consisting of flexible membranes attached in liquid sealing relationship within the oil tank to the overhead structure, bulk heads and bottom of the tank at the quarter-points thereby separating the oil tank into a cargo section and the ballast section.

Snoddy, U.S. Pat. No. 2,696,185 issued Dec. 7, 1954 describes and illustrates a cargo ship having a pair of flexible membranes or diaphragms attached to the walls to form separate compartments. This permits simultaneous carrying of different types of cargos. The system uses totally flexibly membranes attached horizontally within the vessel.

Hamilton, U.S. Pat. No. 3,922,985 issued Dec. 2, 1975 discloses a submarine tanker which includes an inner, expansible bladder for containing the cargo and for isolating the same from the ballast. These bladders are carried in compartmentalized storage cells.

Other references of interest which illustrates other configurations and techniques for separating a ship's ballast from the cargo and/or for providing flexible membranes in a cargo hold for various purposes, are U.S. Pat. Nos. 2,394,607 of R. B. Gray, et. al., issued: Feb. 12, 1946; U.S. Pat. No. 2,991,906 of L. Eligoulachvili, issued: July 11, 1961; U.S. Pat. No. 3,085,533 of W. M. Goryl, et. al., issued: April 16, 1963; U.S. Pat. No. 3,356,251 of G. S. Roberts, issued: Dec. 5, 1967; U.S. Pat. No. 3,477,401 of Akio Hayama, issued: Nov. 11, 1969; U.S. Pat. No. 3,745,960 of Devine, issued: July 17, 1973; U.S. Pat. No. 3,844,239 of McLaughlin, et. al., issued: Oct. 29, 1974; U.S. Pat. No. 3,957,009 of Di Perna, issued: May 18, 1976.

SUMMARY OF THE INVENTION

The invention relates to a new type of double bottom-tank or deep tank for a ship or otherwise which will allow both liquid cargo and liquid ballast or different kinds of cargo to be carried in the same physical space in the ship at different times, while not allowing any intermingling between the residues or vapours from the cargo or ballast which has been unloaded, with the new ballast or cargo which has been loaded.

The invention consists of a double bottom-tank for fluids, preferably built into or placed in the cargo spaces or double-bottom spaces of a ship. The tank is divided into upper and lower sections. It has a vertically movable rigid partition being the top of the lower section or the bottom of the upper section. The partition is movable between upper and lower positions and guided there between by appropriate guide means. An impermeable flexible sheet of material is secured to the partition and to the sides of the tank to prevent fluid communication between the sections. Appropriate fluid inlet and outlet means are provided for each section, whereby the different fluids can be carried at different times in each section in substantially the same physical space, while not allowing any intermingling between the residues of the fluids from one section to the other. The flexible sheet may consist of rubber or other impervious or oil tight material and connects the fixed and movable parts of the tank at all times. This sheet is made long enough to assume the inner contours of the sides of the ship when the partition is in its lowest, i.e. cargo, position in a ship.

This movable partition and attachments, together with the connected flexible sheet, which in turn is connected to a fixed part of the tank top or sides, can be considered to be a diaphragm.

The diaphragm can be raised or lowered by any appropriate means, for example by one or by a combination of the following methods:

a hydraulic cylinder or ram;
an air cylinder or ram;
a steam cylinder or ram;
air pressure in the ballast space acting on the diaphragm;
water pressure in the ballast space acting on the diaphragm (e.g. by "floating" the diaphragm);
hook and wire from winch on deck.

In addition to the close fit of the central ram and cylinder, the movable partition of the tank i.e. the diaphragm lid, is firmly held or guided in its various positions by suitable mechanical means, including one, or a combination, of the following: guide bars, recessed landings and spigots, hydraulic locking pins, and splines on the central ram which mesh with a keyway in a fixed guide bearing.

The flexible sheet, when hanging loosely, is restrained as necessary by springs or pieces of elastic material.

Use of a tank according to the present invention on a ship permits avoidance of pollution of the marine environment by allowing ballast water to be discharged from these tanks in the same general condition in which it is loaded i.e. completely uncontaminated by cargo residues or vapours. In addition, the shipowner is provided with a smaller displacement ship for the same cargo carrying capacity than would be the case with a similar ship fitted with segregated ballast tanks.

Because of the higher cargo capacity to displacement ratio of the tank accoding to the present invention, in comparison with a similar cargo capacity ship fitted with segregated ballast tanks, there are additionally savings in fuel costs to the shipowner whether the ship is in loaded or ballast condition. The device according to the present invention allows increased flexibility in the amount of ballast water carried in the ship at any particular time, thus allowing the ship's captain to decide on the optimum amount of ballast water to suit the prevailing weather conditions, thereby permitting greater safety and economy in the ballasted conditions.

If a ship is fitted with a diaphragm tanks according to the present invention in each cargo space, the ship's captain is allowed greater flexibility in deciding on the location of the ballast water in the ship, thereby avoiding unnecessary strain on the ship's structure.

Additionally, the invention permits designing, if it is considered necessary, a space between the diaphragm lid when it is at its lowest position, and the bottom of the ship, thus providing double-bottom space to the shipowner's requirements when the ship is in the loaded condition. It will be understood that the ballast space of the tank according to the present invention may alternatively be used for cargo if required on the return unloaded voyage, for example fresh water for industrial or agricultural purposes may be carried on a voyage between Canada and the Middle East. Alternatively, such tanks may be used for carrying oil bunkers in the ballast space where the cargo space in which the tank is fitted is in the cargo unloaded condition.

The device according to the present invention permits compensation for the cost of installation of such tanks by the use of less steel during construction than would be the case on an identical cargo carrying capacity ship fitted with the segregated ballast system.

An oil tanker fitted with tanks according to the present invention will additionally have less freeboard than a similar cargo carrying capacity oil tanker fitted with segregated ballast tanks. Thus, when both ships are fully loaded, due to the smaller pressure head of oil above the ship's water line in the former case, less oil will escape to the sea from the ship so fitted, in the event of identical underwater damage to both ships.

BRIEF DESCRIPTION OF THE DRAWINGS

Other objects and advantages of the invention will become apparent upon reading the following detailed description and upon referring to the drawings in which.

In the drawings, like characters of reference designate similar parts in the several Figures.

Figure 3:
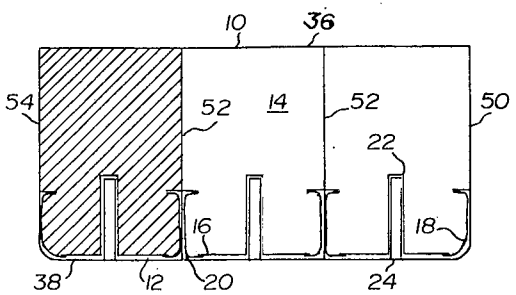
FIG. 3 is a transverse cross-sectional elevation of the aft part of FIG. 1.

While the invention will be described in connection with example embodiments, it will be understood that it is not intended to limit the invention to those embodiments. On the contrary it is intended to cover all alternatives, modifications and equivalents as may be included within the spirit and scope of the invention as defined by the appended claims.

DETAILED DESCRIPTION OF THE INVENTION

For reasons of clarity, emphasis throughout this detailed description will be placed on the invention as applied to oil tankers, but it will be understood that the invention, with slight and obvious modification is also suitable for use in cargo ships and for other uses outside the shipping industry, for example in tanks used on land.

Also should the owner so wish, with slight and obvious modifications the diaphragm can be placed in the side of a tank i.e. with the diaphragm lid or partition in a vertical position.

All materials may be of steel except where specifically stated otherwise.

In the drawings cargo tanks are shown with transverse framing, but it will be understood that longitudinal framing, or other types of stiffening, can be used with the diaphragm tank system to the shipowner's requirements.

Figure 1:
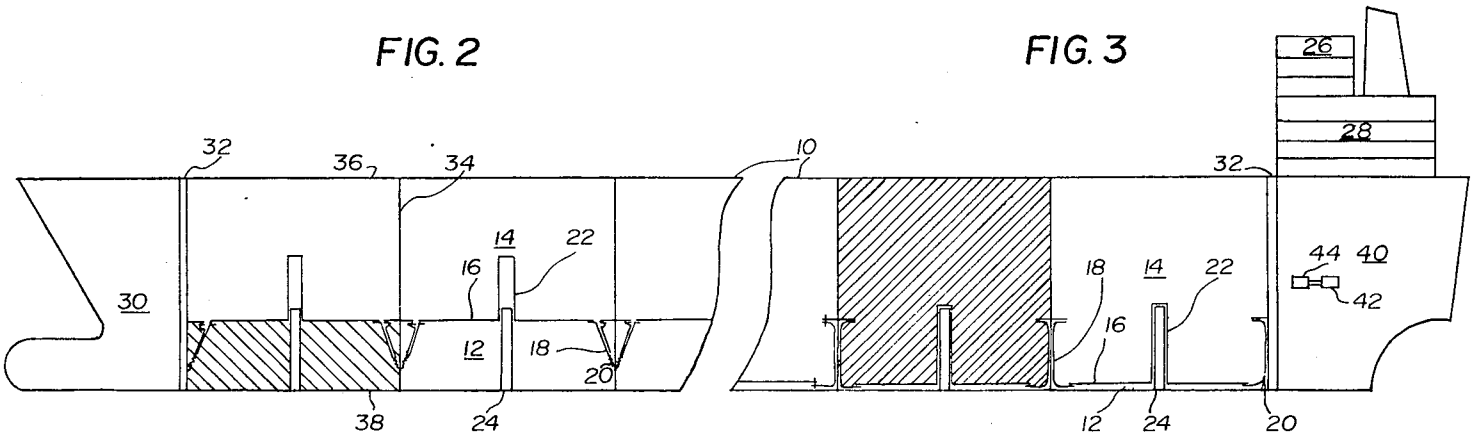
FIG. 1 is a longitudinal cross-sectional elevation of a V.L.C.C. (very large crude oil carrier) fitted with diaphragm tanks in its cargo spaces. The part of the drawing forward of the broken lines shows the ship in the ballasted condition. The part of the drawing aft of the broken lines shows the ship in the loaded condition.

Referring to FIG. 1, the part of ship 10 forward of the broken lines shows the condition of the ship when on a voyage carrying ballast only. In this condition the diaphragm lids or partitions 16 have been adjusted and locked in the highest position with the flexible sheet 18 part of the diaphragm being restrained or held in position by strips of elastic material 20. Hydraulic pressure between the movable cylinder 22 and the fixed ram 24 has raised the diaphragm lids 16 to their present positions. The cargo sections or spaces 14 above the diaphragm lids 16 are empty, and the ballast sections or spaces 12 below the diaphragm lid 16 are filled with water ballast.

The part of ship 10 aft of the broken lines shows the condition of the ship 10 when on a voyage carrying a full cargo of oil. In this condition the diaphragm lids 16 have been adjusted to their lowest position, with the cargo spaces 14 filled with oil and with the ballast, or optional double-bottom spaces 12 being empty.

The navigation bridge 26, crew accomodation 28, bow spaces 30, void spaces 32, transverse bulkheads 34, and main deck 36, are conventional.

The bottom 38 of the ship 10 is also conventional, except that internal stiffening may have to be rearranged to accept the diaphragm lids 16 when they are in the lowered position.

The propulsion machinery space 40 is also conventional, except that any machinery for operating the diaphragms may be located in this space. Example, electric motor 42 driving hydraulic pump 44 in connection with hydraulic cylinders 22.

Figure 2:
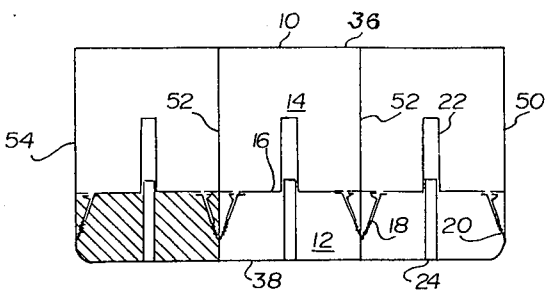
FIG. 2 is a transverse cross-sectional elevation of the forward part of FIG. 1.

Referring to FIG. 2, this shows a transverse cross-sectional elevation of the part of FIG. 1 forward of the broken lines. The port side 50, longitudinal bulkheads 52, and the starboard side 54, of ship 10 are conventional.

Referring to FIG. 3, this shows a transverse cross-sectional elevation of the part of FIG. 1 aft of the broken lines.

Figure 4:
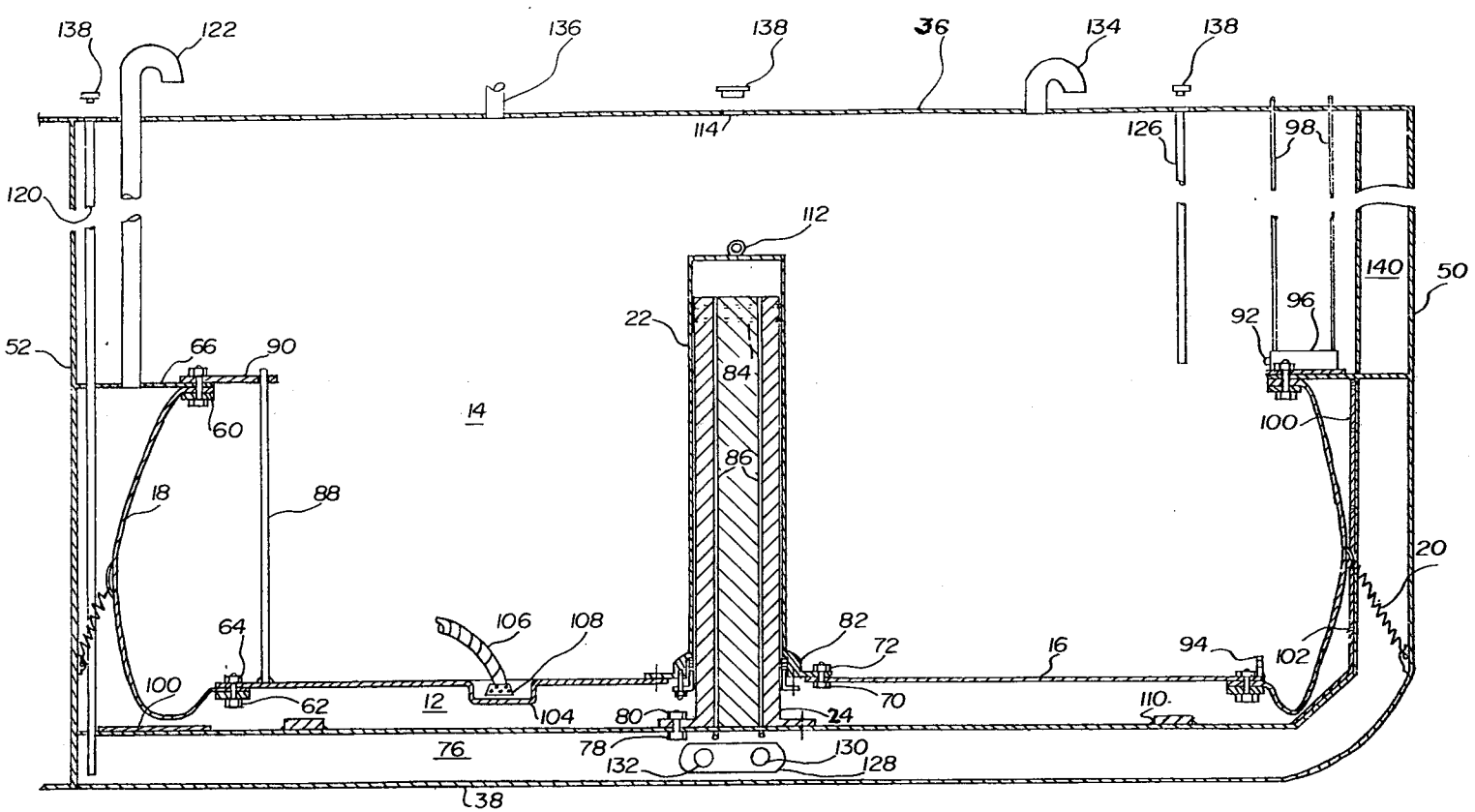
FIG. 4 is a transverse cross-sectional elevation of a diaphragm double-bottom tank, fitted in a cargo tank of an oil tanker. The diaphragm is operated by a hydraulic cylinder.

Referring to FIG. 4, the diaphragm lid 16 is shown near its lowest position.

The diaphragm lid 16 is attached to the watertight flexible fabric sheet 18 by means of clamp bars 60 secured by bolts 62 and nuts 64. The squeezing of the ends of the sheet 18, between the clamp bars 60 and the diaphragm lid 16 at one end, and between the clamp bars 60 and the fixed tank top 66 at the other end, ensures watertight/oiltight joints.

A circular piece is cut out of the centre of the diaphragm lid 16 and a hydraulic cylinder 22 is attached to the diaphragm lid 16 by means of bolts 70 and nuts 72. A hydraulic ram 24 is bolted to the bottom transverse stiffening frames 76 of ship 10 by bolts 78 and nuts 80. A packing gland 82 is fitted at the lower end of hydraulic cylinder 22. Piston rings 84, or other hydraulic oil restraining devices, are fitted at the upper end of ram 24. Hydraulic oil inlet and return conduits 86 are fitted inside the hydraulic ram 24, these conduits can be either pipes or drilled holes, depending on whether the ram is hollow or solid.

A guide bar 88 is attached to the diaphragm lid 16. This guide bar 88 passes through a close fit hole in the guide plate 90 which is attached to the fixed part of the tank top 66.

When the diaphragm lid 16 is in its highest position a locking pin 92, which is attached to the fixed part of the tank top 66, fits into a hole in the locking plate 94, which is attached to the diaphragm lid 16. The locking pin 92 is operated by a small hydraulic cylinder 96 which uses hydraulic oil supplied and returned to a hydraulic pump by small hydraulic oil pipes 98. The hydraulic pump which is used to operate the small hydraulic cylinder 96 can be the same pump which is used to operate the large hydraulic cylinder 22, or it can be a separate pump, as convenient. More than one guide bar 88 and locking pin 92 may be used for each diaphragm lid 16.

The fabric sheet 18 is held in a secure position, when there is no oil cargo, by strips of elastic mterial or springs 20 which are attached to the fabric sheet 18 and to a suitable fixed part of the tank. When cargo is loaded in the cargo space 14, the pressure head of the cargo keeps the fabric sheet 18 firmly pressed agaisnt the fabric sheet support plates 100. These fabric sheet support plates 100 may have small holes 102 drilled in them to avoid trapping air between the plates 100 and the fabric sheet 18. Where there are no sharp projections which might damage the sheet, the diaphragm sheet 18 may follow the inner contour of the ballast space 12 and rest directly against the tank plating.

An oil cargo bilge well 104 is formed in the diaphragm lid 16. The oil cargo well 104 is fitted with a flexible reinforced suction hose 106, and strainer 108.

Seatings 110 are attached and spread out as necessary to the tops of the bottom transverse stiffening frames 76 to take the weight of the diaphragm lid 16, plus the cargo weight, when cargo is loaded. The height of the seatings 110 will govern the amount of space allowed as double-bottom tank space when the ship 10 is in the loaded condition.

Should the hydraulic cylinder 22, or other parts of the hydraulic system, malfunction, the diaphragm lid 16 can be raised e.g. by floating, if it is of a suitable construction or by means of a winch on deck operating a wire and hook attached to the eye-bolt 112. The hook and the wire are passed through a hole 114, in the main deck 36, which is directly above the centre of the hydraulic cylinder 22.

The ballast sounding pipe 120 and the ballast space air vent pipe 122 are both attached to the fixed part of the tank top 66.

The oil cargo space sounding pipe 126 is located over the diaphragm lid 16 and is left short enough to clear the diaphragm lid 16 when it is in its highest position.

Holes 128 are cut in the bottom transverse stiffening frames 76, for the ballast space filling pipe 130 and for the ballast space suction pipe 132.

The cargo space air vent 134, cargo space filling pipe 136, screwed caps 138 side stiffening frames 140 and bottom stiffening frames 76 are conventional.

Figure 5:
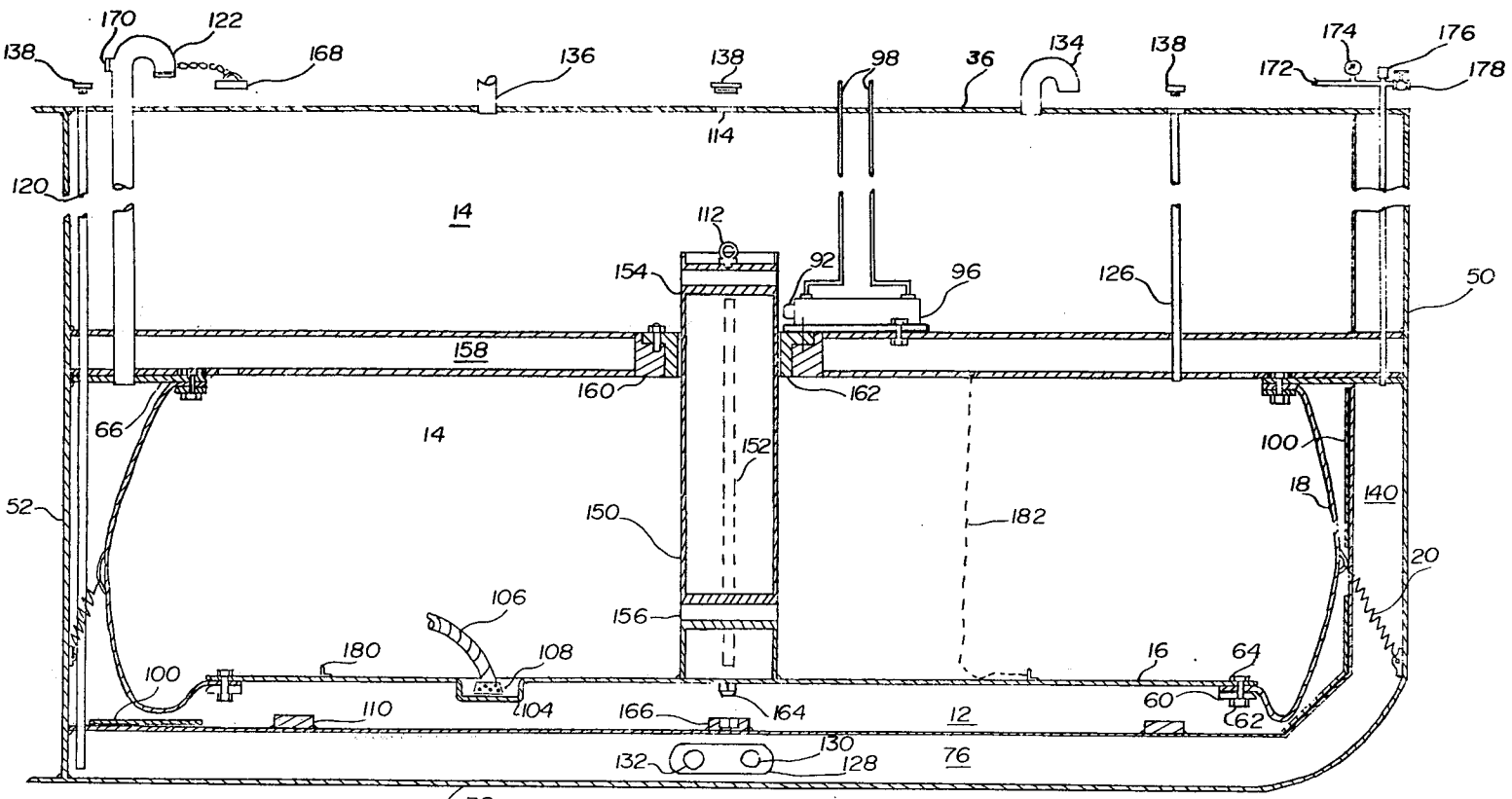
FIG. 5 is a transverse cross-sectional elevation of a diaphragm double-bottom tank, fitted in a cargo tank of an oil tanker. The diaphragm is operated by air pressure although it could also be operated by ballast water pressure.

Referring to FIG. 5, this is basically the same tank configuration as in FIG. 4, but with the major difference that the diaphragm lid 16 is raised or lowered by air pressure, or by ballast water pressure, instead of by hydraulic oil pressure, i.e. the diaphragm lid 16 in effect becomes a piston operated by low pressure air, or water, in the ballast space 12.

A guide cylinder 150 is attached to the top of the diaphragm lid 16. This guide cylinder 150 is fitted with a guide spline 152, a locking pin cylinderical seating 154 to hold the diaphragm lid 16 when in its lowest position and a locking pin cylinderical seating 156 to hold the diaphragm lid 16 when in its highest position.

A horizontal beam 158, which may be box-shaped as drawn, has its ends welded to the sides of cargo space 14. The beam 158 is cut near its centre and a solid bearing seating ring 160 is attached as shown. A bronze guide bearing 162 for the guide cylinder 150 is fitted in the seating ring 160.

A square locating spigot 164 fits into the spigot seating 166 when the diaphragm lid 16 is in its lowest position.

The ballast space air vent pipe 122 is fitted with an airtight screwed cap 168 and with a low pressure bursting disc 170.

A low pressure air filling line 172, for the ballast space 12, is fitted with a pressure gauge 174, an air relief valve 176 and a manually operated air dump valve 178.

The diaphragm lid 16 may be reinforced by "L" shaped bars 180 or similar material as necessary.

An electrical spark ground wire 182 is fitted between the diaphragm lid 16 and the beam 158 or other electrically grounded part of ship 10.

Figure 6:
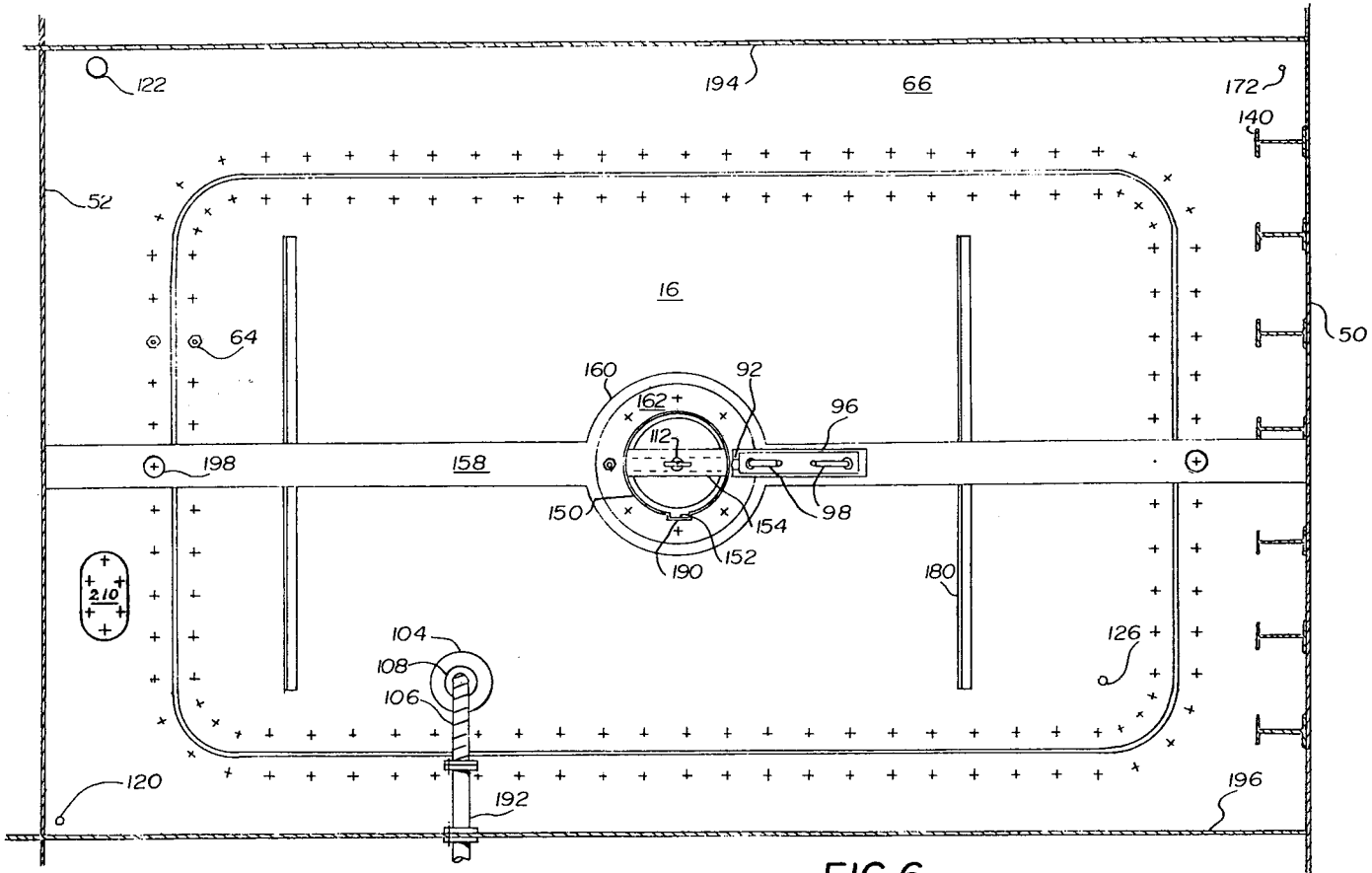
FIG. 6 is a plan view of FIG. 5.

Referring to FIG. 6, the spline 152 on the side of the guide cylinder 150 is a sliding fit in the keyway 190 that is cut in the guide bearing 162.

The top end of the reinforced suction hose 106 is attached to the fixed oil cargo suction pipe 192.

The tank forward bulkhead 194 and the tank aft bulkhead 196 are attached to the ship's port side 50 and to the longitudinal bulkhead 52.

A gasketed manhole 210 is fitted in the tank top 66 to afford access to the double-bottom space 12 for inspection purposes.

Holes 198, to facilitate access to nuts 64, are cut in the horizontal beam 158 as necessary.

Figure 7:
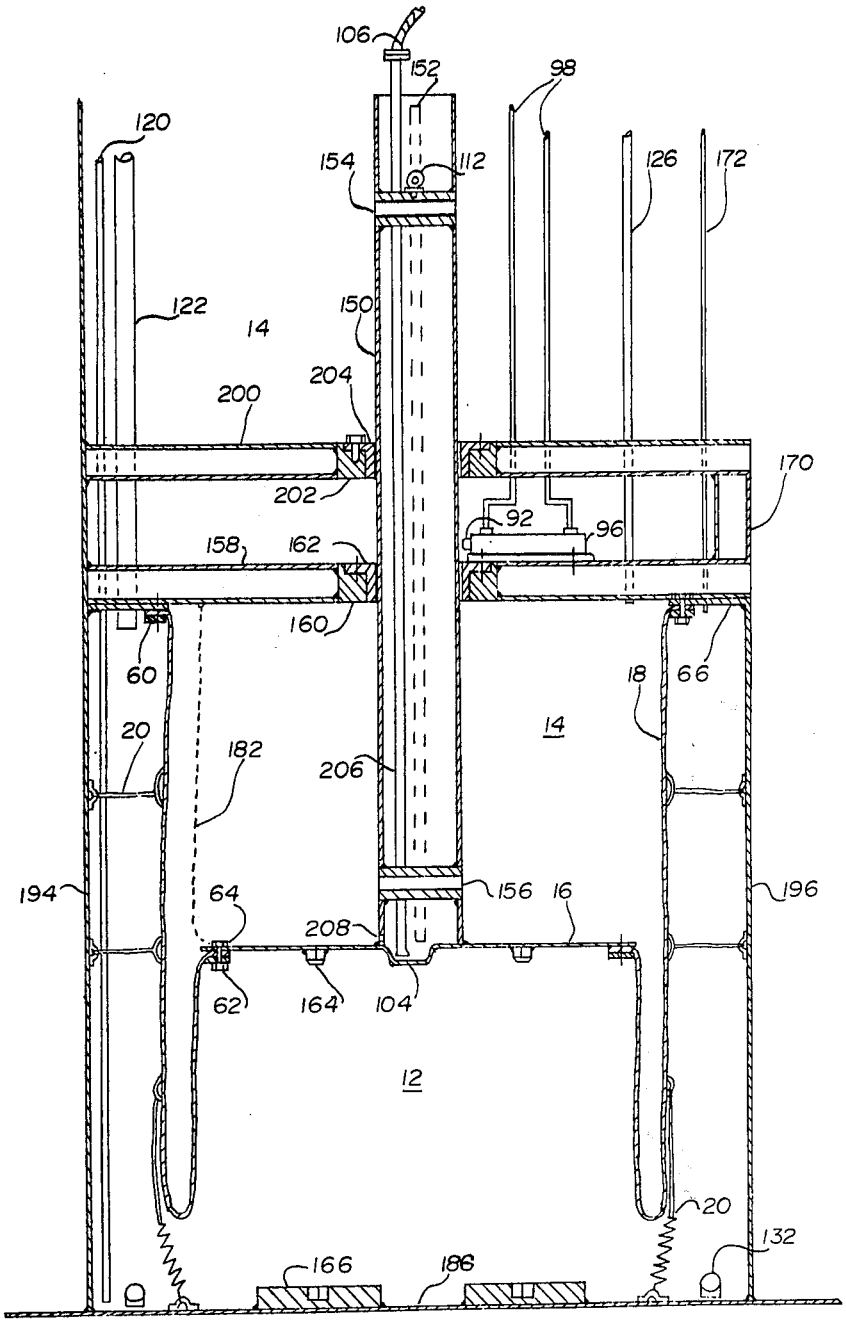
FIG. 7 is a longitudinal cross-sectional elevation of a deeptank, fitted in a cargo hold, or cargo tank, of a ship. The diaphragm is operated by air pressure, although it could also be operated by ballast water pressure.

Referring to FIG. 7, this is basically the same arrangement as in FIG. 5, i.e. the diaphragm lid 16, is raised or lowered by low pressure air, or ballast water. However, since a deep-tank is, as its name implies, generally much deeper that a double-bottom tank, the following alterations or additions have been made.

An additional horizontal beam 200, complete with bearing seating ring 202 and top bronze guide bearing 204 is fitted to give extra stability to the longer cylindrical guide 150 when the diaphragm lid 16 is being raised or lowered.

Additional strips of elastic material or springs 20 are fitted as necessary to locate the much longer fabric sheet 18.

The bottom end of the reinforced suction hose 106 is attached to a vertical oil cargo suction pipe 206 which is fitted inside the hollow guide cylinder 150. Oil cargo drain holes 208 are drilled at the bottom of the guide cylinder 150 and allow the oil cargo to drain into the relocated oil cargo bilge well 104.

The square locating spigot 164 and spigot seating 166 are placed in a different position and additional spigots and seatings are added as necessary.

The tank bottom 186 may also be the bottom of the ship if so designed.

The vertical beam 170 helps to support the top horizontal beam 200.

All fittings at and above the main deck level, which is not shown in FIG. 7, will be similar to those shown in FIG. 5.

The diaphragm lid 16 in FIG. 7 could, with slight and obvious modifications, be raised and lowered by a hydraulic cylinder as in FIG. 4.

The operation of the invention will now be described.

Referring to FIG. 4, when the diaphragm lid or partition 16 is locked in its top position, with cargo space 14 empty, ballast space 12 filled with clean water ballast, it may be desired to discharge the latter and to load oil cargo in space 14. First the ballast pump is started and the ballast water in space 12 is discharged overboard through the ballast space suction pipe 132. The hydraulic oil pump 44, FIG. 1, is next started and the hydraulic cylinder 22 is pressurized through one hydraulic oil pipe 82. The small hydraulic cylinder 96 is also pressurized through one hydraulic oil pipe 98. Both hydraulic cylinder 22 and hydraulic cylinder 96 are remotely controlled from a convenient location. The locking pin 92 is now withdrawn hydraulically from the hole in the locking plate 94. The hydraulic oil pressure in cylinder 22 is now slowly released through the other pipe 98 and the diaphragm lid 16 gently settles to its lowest position on seatings 110. The diaphragm lid 16 is guided at all times by the guide bar 88 which is a sliding fit in the hole in the fixed guide plate 90.

The hydraulic pump 44, FIG. 1, and the ballast pump can now be stopped and the oil cargo loaded into space 14 through the oil cargo inlet pipe 136.

As space 14 fills, the lateral pressure of the oil gently forces the fabric sheet 18 against the sides of the ballast space 12 and against the fabric sheet support plates 100. Any air trapped between the fabric sheet 18 and the fabric sheet support plates 100 can escape through the small holes 102.

When it is desired to unload the oil cargo, the cargo pump is started and the oil cargo space 14 is emptied through the oil cargo suction hose 106. The hydraulic pump 44, FIG. 1, is again started and cylinder 22 is slowly pressurized which slowly raises the diaphragm lid 16 to its top position. The strips of elastic material or springs 20 are positioned to prevent the fabric sheet 18 from getting trapped between the moving diaphragm lid 16 and the fixed tank top 66. The locking pin 92 is now pushed into the hole in the locking plate 94 by hydraulic cylinder 96. The hydraulic oil pump 44, FIG. 1, is next stopped and the ballast space 12 is filled with water through the ballast space filling pipe 130.

It will be understood that with slight and obvious modifications, hydraulic oil cylinder 22 could be adapted to use air or steam as the medium for moving diaphragm lid 16.

Referring to FIG. 5, when the diaphragm lid 16 is locked in its top position, with cargo space 14 empty, ballast space 12 filled with clean water ballast, it is desired to discharge the latter and to load oil cargo in space 14.

Using low pressure air as the diaphragm lid 16 operating medium, the cap 168 is first removed from the ballast space air vent pipe 122. Then the ballast water in space 12 is pumped overboard through the suction pipe 132. When ballast space 12 is empty, cap 168 is replaced and cap 138 is checked for tightness. The air compressor, which is in connection with pipe 172, is now started and compressed air is allowed into ballast space 12. Bearing in mind the large "piston area" and relatively low weight of the diaphragm lid 16, the compressed air will have a very low pressure. When the low pressure air, acting beneath the diaphrgm lid 16, balances the weight of the lid 16, the locking pin 92 can be withdrawn from seating 156. The air compressor can now be stopped and the air in space 12 slowly released through valve 178. This will allow the diaphragm lid 16 to gently settle to its lowest position. Spline 152 acting in keyway 190, FIG. 6, in guide bearing 162 prevents the diaphragm lid 16 from rotating while it is being lowered. At its lowest position diaphragm lid 16 is locked in position by pin 92 being pushed into seating 154. The oil cargo can now be loaded through pipe 136.

With the original condition referred to above i.e. ballast space 12 full and cargo space 14 empty, and using the water ballast as the diaphragm lid 16 operating medium, first remove cap 168 and cap 138. Then, using the ballast pump and ballast filling pipe 130, press up the water ballast in air vent pipe 122, using sounding pipe 120 to check the water level. When the pressure head of the water ballast balances the weight of the diaphragm lid 16, pin 92 can be withdrawn from seat 156. The water ballast can now be pumped overboard from suction pipe 132. This will allow the diaphragm lid 16 to gently settle to its lowest position where it is locked by pushing pin 92 into seating 154. Oil cargo can now be loaded in space 14 through pipe 136.

With slight and obvious modifications the above procedures are reversed when it is desired to unload the cargo and to load water ballast.

While certain novel features of my invention have been shown and described and are pointed out in the appended claim, it will be understood that various substitutions, omissions and changes in the forms and details of the device illustrated and in its operation can be made by those skilled in the art without departing from the spirit of the invention. Therefore what has been set forth is intended to describe and/or illustrate such concept and is not for the purpose of limiting protection to any herein particularily described embodiment thereof.

I claim as my invention:

1. A fluid cargo and ballast tank for the cargo and ballast space of a ship, wherein a vertically movable rigid partition being the top of the lower section and bottom of the upper section divides the space into an upper and lower section, each section to be used to carry fluid at a different time than the other and the partition being movable between upper and lower positions and guided therebetween by appropriate means, the top of the lower section further having a rigid, peripheral top portion secured to the edge of the tank with which the rigid partition mates when in its upper position to provide a rigid top of the lower section extending from wall to wall of the tank, an impermeable, flexible sheet of material secured to the movable partition and to the rigid peripheral top portion of the top of the lower section to prevent fluid communication between the sections, and appropriate fluid inlets and outlets being provided for each section, whereby different fluids can be carried at different times in each section in substantially the same physical space, while not allowing any intermingling between the residues of the fluids from one section to the other.

2. A tank according to claim 1, wherein the partition is movable between upper and lower portions by hydraulic, air or steam cylinder and piston means.

3. A tank according to claim 1, wherein the partition is restrained and guided by a guide bearing means supported by a horizontal beam means above the partition and through which guide bearing a guide cylinder passes, the bottom of the guide cylinder being secured to the partition.

4. A tank according to claim 1 provided with biasing means secured to the flexible sheet and to the corresponding side of the ballast space of the ship to restrain and support the flexible sheet.

5. A tank according to claim 1 wherein the lower section is provided with a vent pipe and means to render the lower section air tight and safe from air over-pressure.

6. Apparatus according to claim 5 wherein the lower section is further provided with an air delivery pipe having appropriate gauge and control means.

7. A tank according to claim 1 wherein the partition is movable between a lower position adjacent the bottom of the lower section and an upper position at or near the top of the upper section.

8. A tank according to claim 1 with means whereby space may be left between the movable partition and the bottom of the ship when cargo is loaded in the upper section, thereby providing double-bottom space in the loaded condition.

9. A tank according to claim 1 wherein the partition is movable between upper and lower positions by air or water pressure acting on the underside of the partition.

10. A tank according to claim 9 wherein the partition floats between upper and lower positions due to water pressure.

11. A tank according to claim 1 wherein the partition is restrained by means of splines and key ways.

12. A tank according to claim 1 wherein the partition is restrained and guided by means of guide plates and guide bars.

13. A tank according to claim 1 wherein the partition is restrained and guided by means of hydraulically operated locking pins.

14. A tank according to claim 1 wherein guide plates appropriately located adjacent the flexible sheet between the flexible sheet and the frames of the lower section restrain and support the flexible sheet.

* * * * *